US010787295B2

(12) United States Patent
Laszczyk et al.

(10) Patent No.: US 10,787,295 B2
(45) Date of Patent: Sep. 29, 2020

(54) METHOD OF MANUFACTURING TEXTURED-SMOOTH HYBRID METAL CLOSURE CAPS

(71) Applicant: CONSTELLIUM NEUF-BRISACH, Biesheim (FR)

(72) Inventors: Laurent Laszczyk, Grenoble (FR); Christian Delclos, Seyssins (FR)

(73) Assignee: CONSTELLIUM NEUF-BRISACH, Biesheim (FR)

( * ) Notice: Subject to any disclaimer, the term of this patent is extended or adjusted under 35 U.S.C. 154(b) by 643 days.

(21) Appl. No.: 15/507,793

(22) PCT Filed: Sep. 2, 2015

(86) PCT No.: PCT/FR2015/052317

§ 371 (c)(1),
(2) Date: Mar. 1, 2017

(87) PCT Pub. No.: WO2016/034813

PCT Pub. Date: Mar. 10, 2016

(65) Prior Publication Data

US 2017/0283126 A1 Oct. 5, 2017

(30) Foreign Application Priority Data

Sep. 5, 2014 (FR) ..... 14 01986

(51) Int. Cl.
*B21D 51/44* (2006.01)
*B65D 41/04* (2006.01)
(Continued)

(52) U.S. Cl.
CPC ..... *B65D 41/04* (2013.01); *B21D 22/28* (2013.01); *B21D 51/44* (2013.01); *B65D 41/62* (2013.01)

(58) Field of Classification Search
CPC ..... B21D 22/28; B21D 51/44; B21D 51/48; B21D 51/446; B21D 51/50
See application file for complete search history.

(56) References Cited

U.S. PATENT DOCUMENTS 4,923,548 A * 5/1990 Granger ..... B65D 41/62 156/182
5,857,373 A 1/1999 De Mare et al.

FOREIGN PATENT DOCUMENTS

CA 2 412 980 A1 6/2003
CA 2 478 648 A1 9/2003
(Continued)

OTHER PUBLICATIONS

Non-English International Search Report dated Dec. 4, 2015 for Application No. PCT/FR2015/052317 with English translation.
(Continued)

*Primary Examiner* — Debra M Sullivan
(74) *Attorney, Agent, or Firm* — Ladas & Parry, LLP; Malcolm J. MacDonald

(57) ABSTRACT

A method of manufacturing a textured-smooth hybrid metal closure cap, and a closing caps produced by the method. The method includes a) the supply of a strip or sheet, made of aluminum alloy known as a "textured" strip or sheet, typically coated on at least one of its faces by a stampable lacquer, b) a first operation for cutting discs, called blanks, c) a step for stamping, in one or more passes, of said blank metal, typically using a stamping lubricant, so as to form a stamped blank, comprising a head and a skirt, typically axially symmetric in the axial direction, d) a step for degreasing said stamped blank, typically intended to eliminate the remaining lubricant, to form a degreased blank that can be lacquered, and e) an optional step of protective lacquering and decoration. After the stamping step, and before the lacquering step, at least one drawing step con-
(Continued)

sisting in passing the stamped blank through drawing rings in order to stretch and thin the metal.

17 Claims, 2 Drawing Sheets

(51) Int. Cl.
*B21D 22/28* (2006.01)
*B65D 41/62* (2006.01)

(56) References Cited

FOREIGN PATENT DOCUMENTS

| | | | |
|---|---|---|---|
| EP | 0 273 402 | A2 | 7/1988 |
| EP | 0 456 162 | A2 | 11/1991 |
| EP | 1 368 140 | B1 | 8/2006 |
| FR | 2 763 046 | A1 | 11/1998 |
| FR | 2 792 617 | A1 | 10/2000 |
| JP | 59-220356 | A | 12/1984 |
| JP | 2006-68837 | A | 3/2006 |
| JP | 2006-272424 | A | 10/2006 |
| WO | 95/08408 | A1 | 3/1995 |
| WO | 97/31783 | A1 | 9/1997 |
| WO | 2005/120743 | A1 | 12/2005 |

OTHER PUBLICATIONS

Espacenet English abstract of FR 2 763 046 A1.
Espacenet English abstract of FR 2 792 617 A1.

* cited by examiner

METHOD OF MANUFACTURING TEXTURED-SMOOTH HYBRID METAL CLOSURE CAPS

SCOPE OF THE INVENTION

The invention relates to the field of closure caps including an external metal shell made of aluminum alloy and particularly screw caps that comprise a threaded inner insert typically made of plastic. These caps are designed to close a container, essentially glass bottles containing alcoholic beverages and particularly wine or spirits.

The invention more particularly relates to a method for manufacturing these caps that makes it possible to obtain a textured appearance on the top, or head, and a smooth or shiny appearance on the "vertical" wall or skirt of the exterior of the cap.

STATE OF THE ART

Closure caps made of aluminum alloy are typically manufactured in the following manner:

- A stamping press forms blanks of caps from a strip or sheet, also referred to as "format", which is cut into blanks, lacquered on both sides, having a thickness typically ranging from 0.15 to 0.25 mm without taking the lacquer into account. Depending on the height of the skirt (length of the cap blank), one or three stamping passes may be required.
- These blanks are degreased in an oven at high temperature, typically from 180 to 210° C., for a period of time ranging from 3 to 5 minutes, in order to eliminate the stamping lubricant.
- Their entire surface is then lacquered and placed in the oven to bake the lacquer.
- These lacquered blanks are printed on the skirt, typically using a screen printing process, known as "offset" to those skilled in the art, with final oven drying of the inks.
- An over-print lacquer is then applied to protect the printing, said lacquer being oven dried.
- The blank thus obtained has a seal and/or a threaded inner insert made of plastic.

Unless otherwise stated, all the aluminum alloys discussed below are designated according to the designations defined by the "Aluminum Association" in the "Registration Record Series" that it publishes regularly.

Problem

The growing interest in attractive solutions has prompted the applicant to test the use of aluminum alloy strips, known to those skilled in the art as "textured" strip or sheet, i.e. having stamped or embossed patterns, typically although not exclusively consisting of lines in one or more directions, conferring a roughness Ra, measured according to standard NF EN ISO 4287, typically greater than 0.5 or even 1.0 μm, for the stamping of cap blanks.

This type of surface is well known to those skilled in the art and notably described in patent applications WO 9731783 A1, WO 9508408 A1, U.S. Pat. No. 5,857,373, EP 0273402 A1 or EP 0456162 A1, CA 2412980 A1, CA 2478648 A1, EP 1368140 A1, etc.

However, after stamping, although the quality of the texture remains largely unchanged on the head of the blank, it is highly downgraded and unsightly on the skirt owing notably to the deformation of the texture pattern(s) during said stamping.

The enhancement of the textured aspect of the initial metal (special grades manufactured by rolling to give a textured and/or iridescent effect on the surface of the metal), is made impossible because of this.

No industrially viable solution is currently known to produce textured caps, either in totality or on the skirt and the top, or even partially, or on the top only, owing to the aforementioned downgrading of the skirt.

The invention described herein aims to overcome this problem by proposing a method for maintaining the initial textured aspect over the entire surface of the head of the blank, and smooth or shiny over the entire height of the skirt, and within industrially economic conditions for the beverage bottle closure cap market.

SUBJECT OF THE INVENTION

The invention relates to a method for the manufacture of metal closure caps comprising:

a) the supply of an aluminum alloy strip or sheet, known to those skilled in the art as "textured" strip or sheet, i.e. having stamped or embossed patterns, typically although not exclusively lines in one or more directions, conferring a roughness Ra, measured according to standard NF EN ISO 4287, typically greater than 0.5 or even 1.0 μm, for the stamping, typically covered on one of its two faces, generally the face intended for the interior of the cap, by a layer of stampable lacquer, i.e. which undergoes no deterioration during the stamping operation, b) a first operation for cutting discs, called blanks, c) a step for stamping and cutting anisotropic horns, in one or more passes, of said blank metal, typically using a stamping lubricant, so as to form a stamped blank, comprising a head and a skirt, typically axially symmetric in the axial direction, d) a step for thermal degreasing said stamped blank, typically at a temperature from 180 to 210° C., for 3 to 5 minutes, or chemically in an alkaline environment, intended to typically eliminate the remaining lubricant, to form a degreased blank that can possibly be lacquered, e) an optional step of protective lacquering and/or decoration, characterized in that it comprises, possibly following on directly from the stamping step, at least one drawing step consisting in passing the stamped blank through at least one drawing ring to stretch and thin the metal.

Typically, the blank has a thickness of 0.15 to 0.25 mm not counting the lacquer. According to the most common embodiment, the drawing ratio (1−final thickness/initial thickness of the sheet or strip) is greater than or equal to 2.5%.

According to a preferential embodiment, it is less than or equal to 30%.

According to a specific embodiment, only the face intended to be on the inside of the cap is coated with a lacquer prior to stamping and the face intended to be on the outside of the cap is lacquered only after the degreasing step.

According to another embodiment, both faces intended to be on the inside and on the outside of the cap are coated with a lacquer prior to stamping.

Advantageously, the lubricant used for stamping is volatile and eliminated by heating.

The same is true for the lubricant used for drawing which, advantageously, is volatile and eliminated by heating, typically in a continuous furnace.

In addition, the same lubricant can be used for both the stamping and drawing steps.

Advantageously, the stamping and drawing steps are linked together in two integral steps, i.e. without another intermediate step and, more advantageously, they are performed in the same press stroke.

Finally, the aluminum alloy may be of the AA3105 type or of the AA8011 type, although not exclusively so.

The invention also relates to a metal closure cap manufactured by the method having one of the previous characteristics, and characterized in that it has a so-called "textured" appearance over the entire surface of the head or top, and a smooth or shiny appearance over the entire height of the skirt, or wall.

DESCRIPTION OF THE FIGURES

FIG. 4 represents the roughness Ra in microns, measured in the lengthwise direction from top to bottom of the wall, for:

Figure 1:
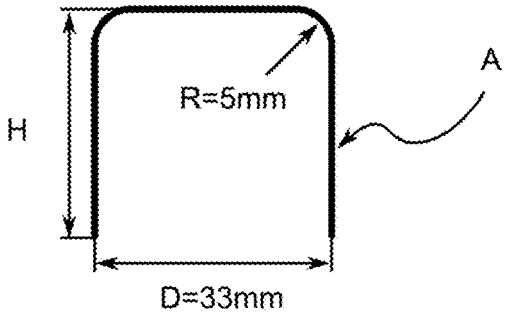
FIG. 1 is a schematic, cross-sectional view of the cap used for the tests. It measures 33 mm in diameter, its height H is 24 mm after stamping, 20 mm after the anisotropy horns are cut away and finally 28 mm after drawing; its top or head or even the "upper part" is flat and is connected to the skirt or vertical wall A with a radius of 5 mm.

The initial sheets, or formats, referenced A, shiny or smooth (0), and textured according to various patterns 1, 2 or 3, The caps that are only stamped, referenced B, obtained from the previous formats 0, 1, 2 and 3, the measurement being performed on the skirt, from top to bottom of the wall, The stamped and drawn caps, referenced C, also obtained from formats and the previous caps B identified 0, 1, 2 and 3, the measurement always being performed on the skirt, at 15 mm from the head of the cap.

DESCRIPTION OF THE INVENTION

As previously stated, owing to the market's growing interest for attractive yet economic closure caps, i.e. of a cost compatible with the requirement of the beverage bottle market and not that of cosmetic products, the applicant had the idea of testing the use of strips made of aluminum alloy, known to those skilled in the art as "textured" strip or sheet, i.e. having stamped or embossed patterns, typically although not exclusively lines in one or more directions, conferring a roughness Ra, measured according to standard NF EN ISO 4287, typically greater than 0.5 or even 1.0 μm, for the stamping of cap blanks.

However, the applicant found that following the stamping, although the quality of the texture remained unchanged on the head or top of the blank, it was highly downgraded and unsightly on the skirt owing to the deformation of the texture pattern(s) during said stamping, in addition to the fact that it presented a more or less matte appearance on the latter.

At the same time, the applicant was involved in a program to reduce the thickness of said closure caps to minimize the quantity of metal used. He was thus able to perform an additional drawing pass following conventional stamping of one or more passes, the latter leading to a non-uniform skirt thickness which could therefore be optimized at its minimum point.

This type of drawing, still known as "coining", is not used in the field of closure caps and is currently used only in that of cans or beverage bottles.

During tests involving so-called "textured" metal, the applicant unexpectedly noted that said texture was maintained on the head, or top, of the cap although it had completely disappeared following said step on the wall or skirt, whereas the aforementioned "matte" appearance was improved with a smooth or shiny appearance.

The invention therefore offers multiple advantages: rendering the thickness of the skirt uniform over its entire height by minimizing the quantity of material used, or allowing taller caps to be manufactured without increasing the quantity of material, and finally, obtaining an attractive effect with a textured appearance on the top or head and smooth or shiny on the skirt or cap wall.

The minimum drawing ratio is justified owing to the fact that the latter must at least bring the thickness of the entire skirt substantially uniformly to the value of the minimum thickness obtained locally after stamping (i.e. 0.203 mm in the case of FIG. 1). The latter depends on the stamping conditions (tool roughness, clearance, pressure of the blank holder, lubrication). It is generally considered that this minimum ratio is 2.5% or even 3%.

The maximum drawing ratio is associated with the drawability limit before break, intrinsic to the alloy, which must not be exceeded during drawing, or coining, of the bottom of the skirt, which is the thickest zone (0.236 mm according to FIG. 1). Its "clearance." value is given by the formula $(1-\text{clearance.})/(1-\text{LIR})=e_{max}/e_{init}$) where LIR is the drawability limit of the metal, $e_{max}$ is the maximum thickness of the lower portion of the skirt (0.236 mm according to FIG. 1) and $e_{init}$ is the initial thickness of the sheet (0.210 mm in the case corresponding to FIG. 1).

In the case of an AA3104 or 3105 type alloy, the industrially permissible drawability limit is 40%. A maximum drawing ratio of substantially 30% is obtained.

The details of the invention will be understood better with the help of the examples below, which are not however restrictive in their scope.

Examples of Embodiments

Stamping Step

Metal strips made of AA8011 type alloy of quality known to those skilled in the art as "textured" strip, of roughness Ra from 0.5 μm to 2.0 μm, thickness 0.210 mm (without lacquer), were cut out to the format 210×75 mm. The first stamping pass was performed on these non-lacquered blanks with tools having the following characteristics:

Diameter of the cutting ring: 64 mm, punch diameter: 33 mm, punch radius: 5 mm, i.e. a stamping ratio Re=Ø blank/Ø punch of 1.94.

The diameter of the female die was 33.68 mm and its radius 2.5 mm.

The surface roughness of the female die in contact with the metal was Ra=0.2.

The lubricant was of known type, bearing the reference "KLÜBERFOOD NH1 16-180".

The blank holder pressure was adjusted to obtain a dish without folds.

Figure 4:
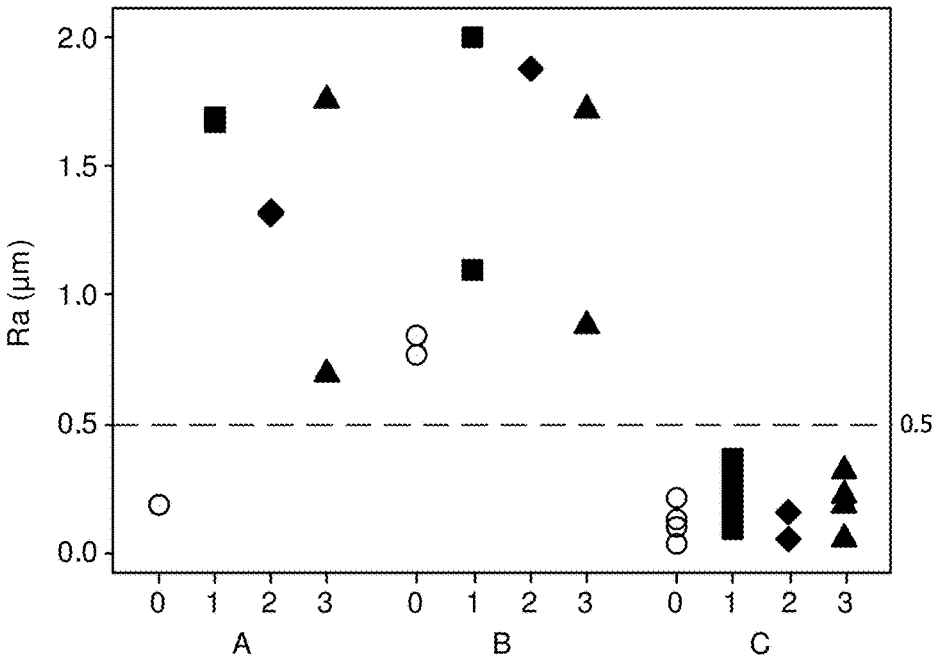

This step enabled cups or caps to be manufactured as schematically represented in the cross-sectional view in FIG. 1, and referenced B in FIG. 4.

Drawing Step

The second drawing pass was performed on cups previously stamped according to step 1 above, with tools having the following characteristics:

Punch diameter: 33 mm

Diameter of the drawing ring at 28.6%: 33.30 mm

The diameter of the drawing rings corresponds to a negative clearance in relation to the initial metal thickness (here metal thickness=0.210 mm) between the diameters of the punch and the female die and is calculated in the following manner:

$$Ø\ \text{Drawing ring} = Ø\ \text{Punch} + (2 \times \text{metal thickness} \times (1 - \text{clearance}\ \%))$$

clearance % being the drawing ratio, here 28.6%, i.e. 0.286

The same lubricant as for the stamping step, "KLÜBERFOOD NH1 16-180", was successfully used, either pure or diluted with water to 80%.

This step enabled stamped drawn caps to be manufactured in compliance with the invention, referenced C in FIG. 4.

Test Results:

The surface roughness Ra was used to quantify the shininess criteria, the latter being shinier in proportion to the smoothness of the surface is smooth, and therefore in inverse proportion to the roughness.

The roughness of the cap, stamped and drawn according to the invention, was compared to the roughness of the cap having only been stamped (according to the prior art), and finally to the initial roughness of the metal in strip or sheet or initial flat format, before the cap was formed.

The roughness was measured on the flat formats and on the wall or skirt of the caps from the top to bottom of the wall.

The following codes are used:

A: flat format,

B: stamped cap,

C: cap stamped then drawn according to the invention.

Figure 2:
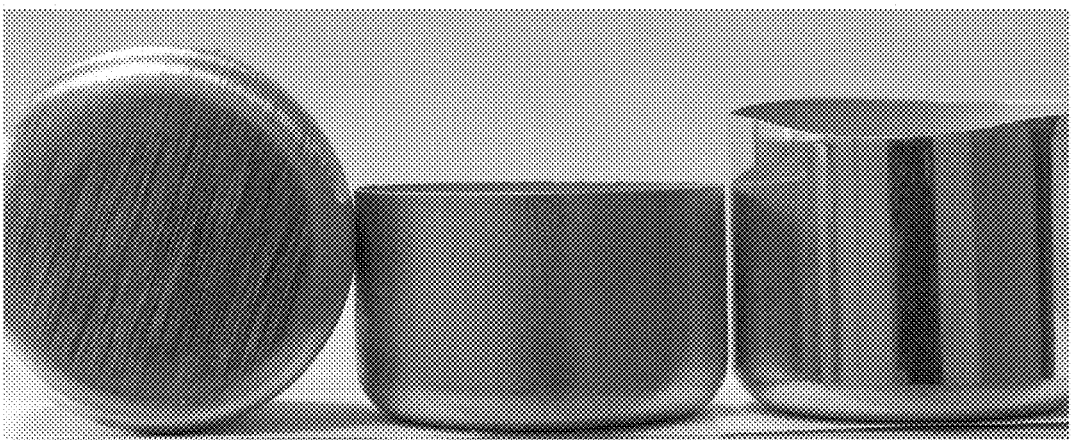
FIG. 2 shows, from left to right, the top of a textured cap with patterns of parallel lines after stamping and drawing according to the invention, a view of the skirt of the same cap after stamping and finally a view of the skirt of the same cap after stamping and drawing where the textured appearance has disappeared to make way for a smooth or shiny appearance.
Figure 3:
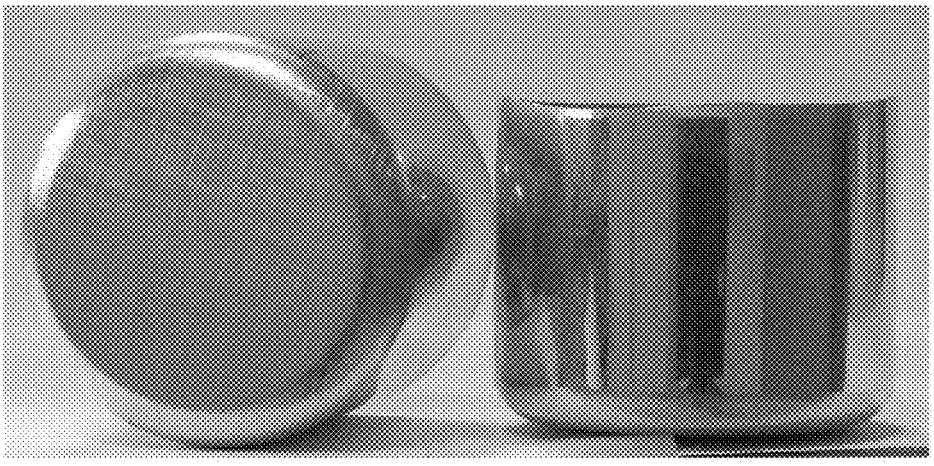
FIG. 3 shows, from left to right, the top of a textured cap with patterns of perpendicular lines after stamping and drawing according to the invention, a view of the skirt of the same cap after stamping and finally a view of the skirt of the same cap after stamping and drawing where the textured appearance has disappeared to once again make way for a smooth or shiny appearance.

Regarding the surface finishes:

0 for the absence of texture, i.e. a shiny or smooth surface, 1 and 2 for textures in parallel lines and 3 for two clusters of parallel lines, crossing at 90°. FIG. 2 shows a stamped cap in the center and two stamped then drawn caps on either side, with texture 2.

FIG. 4 compares the roughnesses of the flat formats A with walls or skirts of caps A of the prior art and with those caps C according to the invention.

It clearly shows that the invention allows the roughness of the wall to be divided by a factor of two to eight.

It also clearly shows, through comparison between caps (A, B) and (C, D) that, on the upper part (or top) of the cap, the roughness remains unchanged, i.e. that the invention does not modify the shininess on the upper part of the cap. It is greater than the initial roughness of the shiny metal, although remains less than the roughness of the so-called "Mill Finish" type as-rolled metal.

This point shows the advantage of using a shiny metal as the initial sheet, in order to make the most of the initial shininess on the upper part of the cap and to obtain, through drawing, improved shininess overall, including the skirt or wall.

These results are identical for all the usual roughness measurement criteria 2D or 3D (Rz, or Sk for example).

The invention claimed is:

1. A method for manufacturing a stamped and drawn aluminum alloy closure cap, comprising the steps of:

cutting a disk from a textured aluminum alloy to form a blank;

stamping the blank in the presence of a stamping lubricant, to form a stamped blank having a head and a skirt;

drawing the stamped blank by passing the stamped blank through a drawing ring to form a stamped and drawn blank;

degreasing the stamped and drawn blank to form the stamped and drawn aluminum alloy closure cap;

wherein the stamped and drawn aluminum alloy closure cap has the following characteristics:

a roughness Ra, measured according to standard NF EN ISO 4287, greater than 0.5 μm over an entire surface of the head; and a roughness Ra, measured according to standard NF EN ISO 4287, less than 0.5 μm over an entire height of the skirt.

2. The method according to claim 1, wherein the blank has a thickness of 0.15 to 0.25 mm.

3. The method according to claim 1, wherein the drawing step is carried out at a drawing rate of greater than, or equal to, 2.5%.

4. The method according to claim 3, wherein the drawing rate is less than, or equal to, 30%.

5. The method according to claim 1, further comprising coating with a lacquer only the face intended to be on the inside of the cap prior to the stamping step, and coating with a lacquer the face intended to be on the outside of the cap only after the degreasing step.

6. The method according to claim 1, further comprising coating with a lacquer the two faces intended to be on the inside and on the outside of the cap prior to the stamping step.

7. The method according to claim 1, wherein the stamping lubricant is volatile and is eliminated by heating.

8. The method according to claim 1, wherein the drawing step is carried out in the presence of a volatile drawing lubricant, which is eliminated by heating.

9. The method according to claim 8, wherein a same lubricant is used for the stamping step and the drawing step.

10. The method according to claim 1, wherein the stamping step and the drawing steps are linked together in two integral steps, without an intermediate step.

11. The method according to claim 1, wherein the stamping step and the drawing step are carried out in a same press stroke.

12. The method according to claim 1, wherein the aluminum alloy is of an AA3105 type.

13. The method according to claim 1, wherein the aluminum alloy is of an AA8011 type.

14. The method according to claim 1, wherein the aluminum alloy is in a form of a strip or sheet.

15. The method according to claim 1, further comprising at least one of lacquering and decorating the stamped and drawn aluminum alloy closure cap.

16. The method according to claim 1, wherein, during the stamping step, anisotropic horns are cut in the blank.

17. The method according to claim 1, wherein, during the drawing step, the aluminum alloy is stretched and thinned.

* * * * *